US009587499B2

(12) United States Patent
Albers et al.

(10) Patent No.: US 9,587,499 B2
(45) Date of Patent: Mar. 7, 2017

(54) INNER RING OF A FLUID FLOW MACHINE AND STATOR VANE ARRAY

(71) Applicant: MTU Aero Engines AG, Munich (DE)

(72) Inventors: Lothar Albers, Munich (DE); Georg Zotz, Haimhausen (DE); Rudolf Pilzweger, Dachau (DE); Hermann Becker, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 346 days.

(21) Appl. No.: 14/537,848

(22) Filed: Nov. 10, 2014

(65) Prior Publication Data

US 2015/0132124 A1 May 14, 2015

(30) Foreign Application Priority Data

Nov. 12, 2013 (EP) ..... 13192465

(51) Int. Cl.
*F01D 9/04* (2006.01)
*F01D 5/22* (2006.01)
*F01D 11/00* (2006.01)

(52) U.S. Cl.
CPC ..... *F01D 9/042* (2013.01); *F01D 5/225* (2013.01); *F01D 9/04* (2013.01); *F01D 11/001* (2013.01); *F01D 11/005* (2013.01); *F05D 2240/11* (2013.01)

(58) Field of Classification Search
CPC . F01D 9/042; F01D 9/04; F01D 9/041; F01D 5/147; F01D 5/225; F01D 11/001; F01D 11/005; F05D 2240/11
USPC ..... 415/174.5, 211.2
See application file for complete search history.

(56) References Cited

U.S. PATENT DOCUMENTS 4,295,785 A * 10/1981 Lardellier ..... F01D 11/02 277/414
4,767,267 A * 8/1988 Salt ..... F01D 11/001 415/173.7
2007/0065286 A1* 3/2007 Bolgar ..... F01D 11/001 416/193 A (Continued)

FOREIGN PATENT DOCUMENTS

DE 10 2011 102598 11/2012
EP 0017534 10/1980
EP 1408199 4/2004

*Primary Examiner* — Dwayne J White
*Assistant Examiner* — Sang K Kim
(74) *Attorney, Agent, or Firm* — Davidson, Davidson & Kappel, LLC

(57) ABSTRACT

An inner ring of a fluid flow machine includes fixing rings and seal carriers split into at least two fixing ring segments and into at least two seal carrier segments, respectively. The fixing ring segments and the seal carrier segments are arranged with the respective end faces facing each other. A first fixing ring segment has a first ring segment shoulder and a second fixing ring segment has an offset second ring segment shoulder. A first seal carrier segment has a first carrier segment shoulder, and a second seal carrier segment has a second carrier segment shoulder, which is offset with respect to the first carrier segment shoulder. In a separation plane of the inner ring, the first carrier segment shoulder abuts the second ring segment shoulder at the end face. Also in the separation plane, the second carrier segment shoulder abuts the first ring segment shoulder at the end face.

13 Claims, 7 Drawing Sheets

(56) References Cited

U.S. PATENT DOCUMENTS

| | | | | |
|---|---|---|---|---|
| 2009/0191053 | A1* | 7/2009 | Bridge | F01D 5/225 415/208.2 |
| 2013/0309075 | A1* | 11/2013 | Brummitt-Brown | F01D 9/045 415/191 |
| 2014/0314556 | A1* | 10/2014 | Fremont | B29C 70/222 415/200 |

* cited by examiner

INNER RING OF A FLUID FLOW MACHINE AND STATOR VANE ARRAY

This claims the benefit of European Patent Application EP13192465.6, filed Nov. 12, 2013 and hereby incorporated by reference herein.

The present invention relates to an inner ring of a fluid flow machine as defined. The present invention also relates to a stator vane.

BACKGROUND

In fluid flow machines, in particular in axial gas turbines, stator vane arrays often have inner rings mounted at their radially inner end, the inner rings allowing attachment of seals thereto. The seals serve to seal off the fluid medium between rotor blade regions located upstream and downstream thereof. There are various embodiments of such inner rings to enable, for example, attachment of the inner ring to the stator vane array, attachment of seals to the inner ring, easy assembly and disassembly for maintenance and repair purposes, as well as cost-effective manufacture.

SUMMARY OF THE INVENTION

It is an object of the present invention to provide an inner ring for fluid flow machines, which allows easy assembly and disassembly of individual segments of the inner ring and is inexpensive to manufacture. Another object of the present invention is to provide a stator vane array having an inner ring according to the present invention.

It is an object of the present invention to provide an inner ring of a fluid flow machine, in particular of an axial fluid flow machine, and more particularly of an axial gas turbine, for attachment to stator vanes and for receiving seal segments. The multi-part inner ring has at least one fixing ring and one seal carrier. Both the fixing ring and the seal carrier are divided or segmented into at least two segments in the circumferential direction. These fixing ring segments and seal carrier segments are arranged in the circumferential direction of the inner ring with the respective end faces facing each other.

In accordance with the present invention, the fixing ring segments have ring segment shoulders. A first fixing ring segment has a first ring segment shoulder, and a second fixing ring segment has a second ring segment shoulder, which is offset with respect to the first ring segment shoulder. The second ring segment shoulder is disposed at an offset with respect to the first ring segment shoulder. In particular, the second ring segment shoulder is disposed at a radial offset with respect to the first ring segment shoulder.

Moreover, in accordance with the present invention, a first seal carrier segment has a first carrier segment shoulder, and a second seal carrier segment has a second carrier segment shoulder, which is offset with respect to the first carrier segment shoulder. The second carrier segment shoulder is disposed at an offset with respect to the first carrier segment shoulder. In particular, the second carrier segment shoulder is disposed at a radial offset with respect to the first carrier segment shoulder.

In a separation plane of the inner ring, the first ring segment shoulder is disposed such that its end face is at least partially located at, or abuts, the second carrier segment shoulder in the circumferential direction. Furthermore, in this separation plane, the second ring segment shoulder is disposed such that its end face at least partially abuts the first carrier segment shoulder in the circumferential direction.

In particular, the first fixing ring segment and the first seal carrier segment are not, preferably completely or substantially not, movable beyond the separation plane in the circumferential direction. The segments are not movable beyond the separation plane because the first ring segment shoulder abuts the second carrier segment shoulder and thereby prevents or blocks movement.

Moreover, in particular, the second fixing ring segment and the second seal carrier segment are not, preferably completely or substantially not, movable beyond the separation plane in the circumferential direction. The segments are not movable beyond the separation plane because the second ring segment shoulder abuts the first carrier segment shoulder and thereby prevents or blocks movement.

The stator vane array of the present invention has an inner ring according to the present invention.

In all of the above and following discussion, the expressions "may be" and "may have", etc., will be understood to be synonymous with "is preferably" and "preferably has", etc., and are intended to illustrate specific embodiments according to the present invention.

Whenever number words are mentioned herein, these will be understood by those skilled in the art as an indication of a lower numerical limit. Therefore, for example, when "one" is specified, those skilled in the art will always read this to imply "at least one", unless this would constitute a contradiction recognizable by those skilled in the art. This understanding is included in the present invention, as well as the interpretation that a number word such as "one" may alternatively be meant to mean "exactly one" whenever this is recognizable as technically possible by those skilled in the art. Both of these cases are covered by the present invention and apply to all number words used herein.

Specific exemplary embodiments of the present invention may include one or more of the features mentioned below.

In the following, in particular, gas turbines will be described merely as an example of fluid flow machines, but without limiting fluid flow machines to gas turbines. The fluid flow machine may, in particular, be an axial fluid flow machine. The gas turbine may, in particular, be an axial gas turbine such as, for example, an aircraft gas turbine.

In certain embodiments of the present invention, the second ring segment shoulder is disposed at a radial offset with respect to the first ring segment shoulder. Alternatively or additionally, the second ring segment shoulder may be offset axially, diagonally, or be disposed in a different arrangement, with respect to the first ring segment shoulder.

In certain embodiments of the present invention, the second carrier segment shoulder is disposed at a radial offset with respect to the first carrier segment shoulder. Alternatively or additionally, the second carrier segment shoulder may be offset axially, diagonally, or be disposed in a different arrangement, with respect to the first carrier segment shoulder.

In several embodiments of the present invention, the inner ring, in particular the fixing ring of the inner ring, is connected to the radially inner end of the stator vane or attached to the stator vane.

In some embodiments of the inner ring according to the present invention, one or more seal coatings, in particular abradable seal coatings, are preferably attached to radially inner ends of the seal carrier segments. The seal coatings may be parts of sections of the inner ring.

In certain embodiments of the present invention, the inner ring has connecting pins in the circumferential direction to connect two adjacent fixing ring segments, respectively. In particular, the connecting pins are disposed at or in separation planes of the inner ring.

In certain embodiments of the inner ring according to the present invention, the fixing ring segments do not have any additional pins, shoulders, keys, or the like, to support or secure the fixing ring segments, for example, against additional, radially abutting inner ring segments.

In several embodiments of the inner ring according to the present invention, the first fixing ring segment bears against the second fixing ring segment in the circumferential direction in a first separation plane on the one hand, and on the other hand, in addition, the first ring segment shoulder of the first fixing ring segment bears against the second carrier segment shoulder of the second seal carrier segment, in particular in the first separation plane.

In certain embodiments of the inner ring according to the present invention, the first seal carrier segment bears against the second seal carrier segment in the circumferential direction in a separation plane, in particular in the first separation plane, on the one hand, and on the other hand, in addition, the first carrier segment shoulder of the first seal carrier segment bears against the second ring segment shoulder of the second fixing ring segment, in particular in the first separation plane.

In some embodiments of the inner ring according to the present invention, the first ring segment shoulder is integrally connected to the first fixing ring segment and/or the second ring segment shoulder is integrally connected to the second fixing ring segment. An integral connection is in particular understood to be a one-piece connection, for example, a one-piece component which is produced as a single piece using a casting method or which is machined as a single piece.

In several embodiments of the inner ring according to the present invention, the first ring segment shoulder is connected to the first fixing ring segment and/or the second ring segment shoulder is connected to the second fixing ring segment using a joining method such as, for example, welding or brazing.

In certain embodiments of the inner ring according to the present invention, the first carrier segment shoulder is integrally connected to the first seal carrier segment and/or the second carrier segment shoulder is integrally connected to the second seal carrier segment.

In certain embodiments of the inner ring according to the present invention, the first and second fixing ring segments and/or the first and second seal carrier segments each have a circumferential angle of 180 degrees. A circumferential angle of 180 degrees allows the two halves to bear against each other. In particular, the two circumferential halves do not bear against any further components. Thus, circumferential retention of the two circumferential halves is accomplished, in particular, at a separation plane of the seal carrier segments.

In certain embodiments of the present invention, the fixing ring segments are supported on stator vane trunnions. Stator vane trunnions may be trunnions or pins provided at the radially inner end of the stator vane to connect the stator vanes to the fixing ring segments.

In several embodiments of the inner ring according to the present invention, the first and second fixing ring segments and/or the first and second seal carrier segments each have a circumferential angle of 120 degrees or 90 degrees or 60 degrees or a different angle.

In some embodiments of the inner ring according to the present invention, the first carrier segment shoulder is located at the radially outer end of the seal carrier segment. In particular, the first carrier segment shoulder is located at a separation plane of the inner ring and bears against a ring segment shoulder of a fixing ring segment, which shoulder is located at the end face at the radially outer end. This fixing ring segment may be disposed adjacent to the seal carrier segment in the circumferential direction.

In certain exemplary embodiments of the inner ring according to the present invention, the first and/or second carrier segment shoulders and/or the first and/or second ring segment shoulders each extend over the entire circumferential length of the respective seal carrier segment or fixing ring segment. In this specific embodiment, the seal carrier segment and/or the fixing ring segment may advantageously be produced as a turned part. After the first manufacturing step on a lathe, the respective turned part, the seal carrier and/or the fixing ring may, for example, be split into two 180-degree segments, which may each be inserted into an inner ring.

In certain embodiments of the inner ring according to the present invention, the carrier segment shoulders and/or the ring segment shoulders each extend over a shorter circumferential length as compared to the circumferential length of the respective seal carrier segment or fixing ring segment. For example, the shoulders may extend over 10 or 20 degrees in the circumferential direction, the segments encompassing, for example, 180 degrees.

In several exemplary embodiments of the inner ring according to the present invention, the first and/or the second carrier segment shoulder is disposed on an axially downstream, radially extending portion of the respective seal carrier segment. This portion may be referred to as "bulkhead."

In certain exemplary embodiments of the inner ring according to the present invention, the ratio of the axial width to the radial extent of the portion is 1:6 or less; i.e., for example, 1:10, 1:20 or 1:30, the axial width being determined without the carrier segment shoulder. For example, the axial width may be about 4 mm and the radial extent of the portion may be about 24 mm, or the axial width may be about 3 mm and the radial extent of the portion may be about 18 mm. The bending stiffness of the seal carrier segment may advantageously be influenced or modified both via the ratio of the axial width to the radial extent and via the absolute dimensions.

In certain embodiments of the inner ring according to the present invention, the first and/or the second fixing ring segment is provided at one or both end faces with at least one bore in the circumferential direction. This bore may be a receptacle or recess. The bore is provided and configured, in particular, to receive a pin for connecting the fixing ring segments. The pins may be configured identically or differently in two or more separation planes of the inner ring. For example, the pins may differ in length or diameter. Preferably, the pins are configured identically in all separation planes.

In some exemplary embodiments of the inner ring according to the present invention, the first and/or the second seal carrier segment has abradable seals for sealing off against a fluid medium of the axial fluid flow machine. In particular, all seal carrier segments are provided with abradable seals on their radially inner side.

In certain embodiments of the present invention, the stator vane array is connected to a casing of an axial compressor, in particular of an axial high-pressure compressor.

In certain embodiments of the present invention, the inner ring does not have a pin (or any other positioning device or aid, in particular for the fixing ring segments).

Some or all of the embodiments of the present invention may have one, several or all of the advantages mentioned above and/or hereinafter.

During assembly of the inner ring according to the present invention, the seal carrier segments may be slid onto the fixing ring segments in the circumferential direction. At the separation planes, the seal carrier segments may then advantageously be secured against displacement or rotation in the circumferential direction by means of the radially offset carrier segment shoulders and ring segment shoulders in order to prevent them from moving beyond the separation plane onto the circumferentially adjacent fixing ring segment during the intended operation of the stator vanes in the gas turbine. Such displacement beyond the separation plane could hinder or completely inhibit the disassembly of the housing halves (split case) with the inner rings.

Using the inner ring according to the present invention, it is advantageously possible to prevent incorrect assembly, because the respective segments (preferably two 180-degree halves) of the seal carriers and fixing rings differ in design due to the radially offset shoulders (carrier segment shoulders and ring segment shoulders). Advantageously, no two identically designed seal carrier segments are used for one inner ring because, on the one hand, the first seal carrier segment does not fit onto the first fixing ring segment, and on the other hand, the second seal carrier segment does not fit onto the second fixing ring segment.

Furthermore, the inner ring according to the present invention advantageously allows the structural design of the bulkhead to be optimized with respect to the bending stiffness of the seal carrier. Increased bending stiffness of the seal carrier may reduce the so-called "cording effect." The term "cording effect" refers to a thermal effect, in particular in connection with the fixing rings, which may lead to three-dimensional deformation of the inner rings at the separation planes. These deformations may result in increased penetration of sealing fins into the abradable seals, as a result of which the sealing gaps and leaks may become larger. Larger leaks may result in a reduction in efficiency. The bending stiffness of the seal carrier may be increased by purposeful design of the bulkhead (e.g., axial width, radial extent). Increased bending stiffness may counteract the "cording effect", making it possible to reduce a radially deeper penetration of the sealing fins into the abradable seal at the separation planes. Thus, the efficiency may be positively influenced.

The bending stiffness may advantageously be further optimized through the structural design of the shoulders (e.g., axial width, radial extent).

BRIEF DESCRIPTION OF THE DRAWINGS

The present invention will now be described, by way of example only, with reference to the accompanying drawings, in which identical or similar components are indicated by the same reference numerals. The figures are simplified schematic views in which.

DETAILED DESCRIPTION

Figure 1:
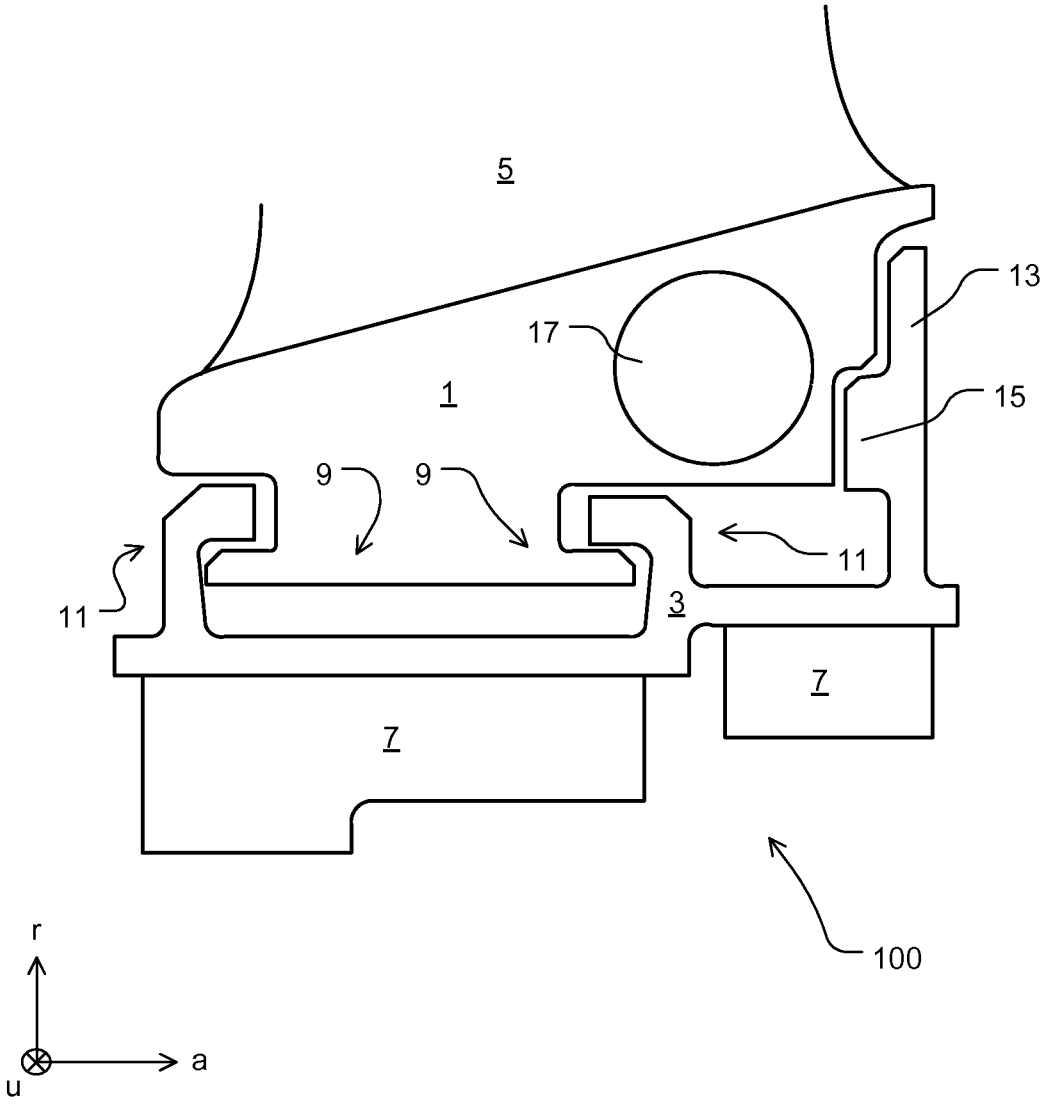
FIG. 1 is an end elevation view of a fixing ring segment and a seal carrier segment of an inner ring according to the present invention.

FIG. 1 shows an inner ring 100 according to the present invention in an end elevation view looking at a fixing ring segment 1 and a seal carrier segment 3. The plane of the elevation view is a separation plane of inner ring 100.

At its radial outer end in the direction r, inner ring 100 is attached to the radially inner end of a stator vane 5. Moreover, inner ring 100 has abradable seals 7 (or abradable seal coatings).

Fixing ring segment 1 and seal carrier segment 3 are telescoped into one another in circumferential direction u. To achieve this connection with a degree of freedom in circumferential direction u, fixing ring segment 1 has a slide 9, which is guided in a guide 11 of seal carrier segment 3.

Seal carrier segment 3 has a radially extending portion 13 having an integral carrier segment shoulder 15. Radially extending portion 13 is also referred to as bulkhead 13.

Fixing ring segment 1 has a bore 17 for connecting two adjacent fixing ring segments 1. A pin 31 (see FIGS. 6 and 7) may be inserted into bore 17 to connect the two fixing ring segments 1 at their end faces in the separation plane.

Figure 2:
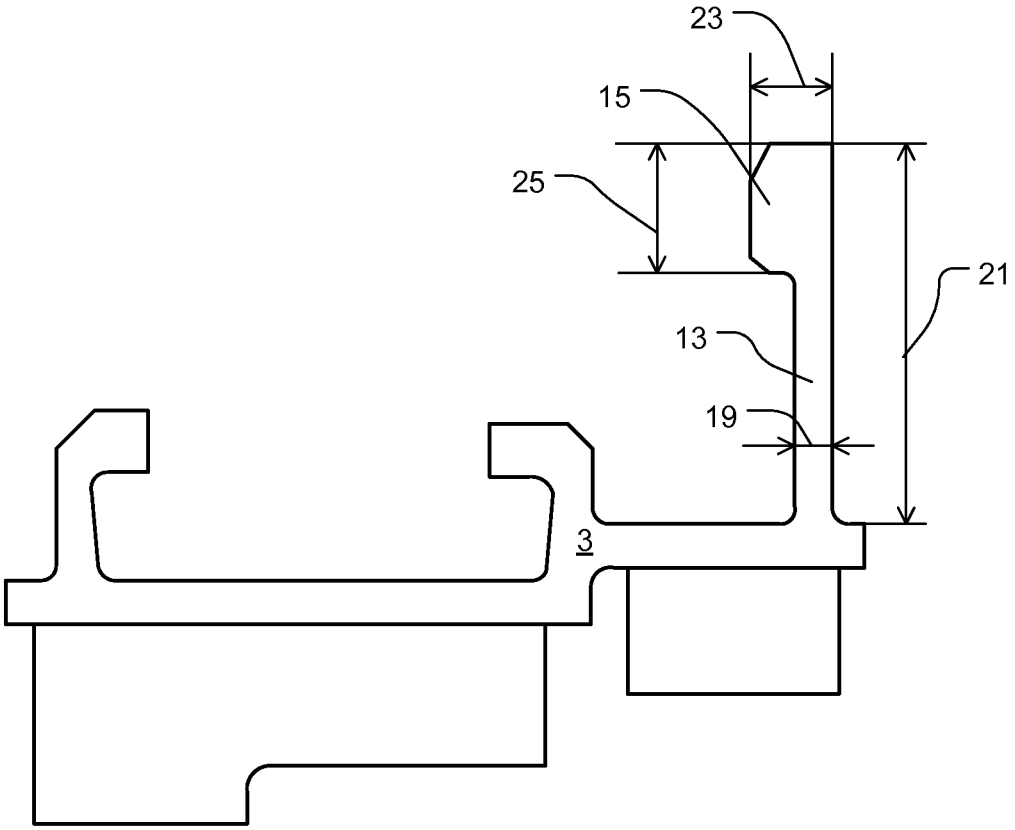
FIG. 2 is an end elevation view of a seal carrier segment of an inner ring according to the present invention having a radially outer carrier segment shoulder.

FIG. 2 shows an end elevation view of seal carrier segment 3 of inner ring 100 according to the present invention having a radially outer carrier segment shoulder 15.

The individual dimensions of bulkhead 13 may considerably influence or alter the bending stiffness of seal carrier segment 3. The bulkhead may be characterized, for example, by the ratio of axial width 19 to radial extent 21. Furthermore, the bending stiffness of the bulkhead may be further influenced and optimized by axial width 23 and radial length 25 of carrier segment shoulder 15.

Figure 3:
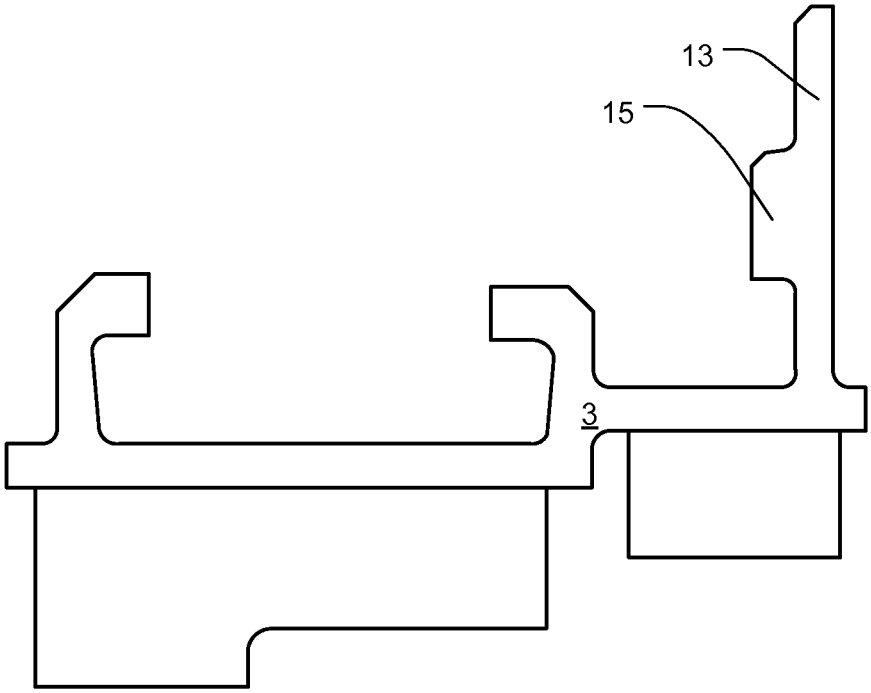
FIG. 3 is an end elevation view of a seal carrier segment of an inner ring according to the present invention having a radially central carrier segment shoulder.

FIG. 3 shows an end elevation view of a seal carrier segment 3 of inner ring 100 according to the present invention having a radially central carrier segment shoulder 15. The location and position of carrier segment shoulder 15 at or on bulkhead 13 is decisive for the supporting function of seal carrier segment 3 against the end face of the adjacent further inner ring segment (not shown in FIG. 3).

In FIG. 3, carrier segment shoulder 15 is disposed at a radial offset with respect to the carrier segment shoulder 15 in FIG. 2.

Figure 4:
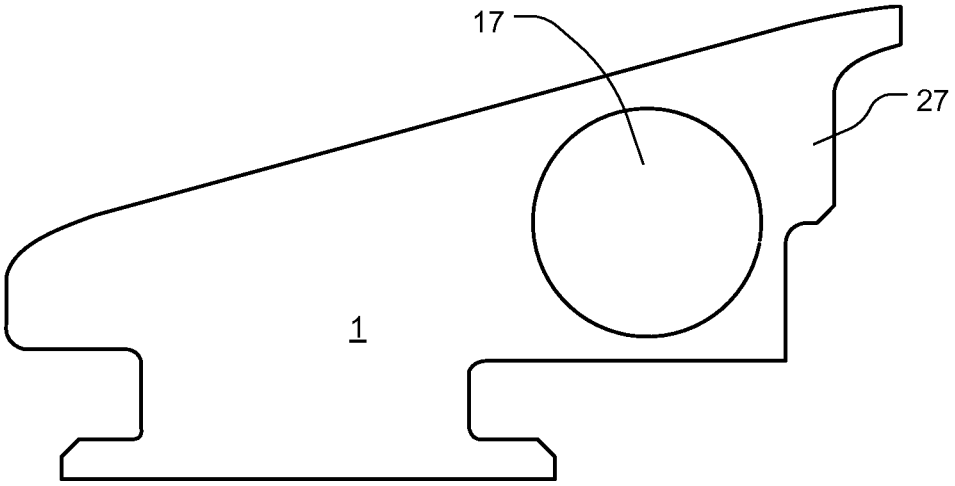
FIG. 4 is an end elevation view of a fixing ring segment of an inner ring according to the present invention having a radially outer ring segment shoulder.

FIG. 4 shows an end elevation view of fixing ring segment 1 of inner ring 100 according to the present invention having a radially outer ring segment shoulder 27.

This fixing ring segment 1 with its radially outer ring segment shoulder 27 is intended to receive seal carrier segment 3 (see FIG. 3). Seal carrier segment 3 is initially rotationally movable in the circumferential direction. However, when a further seal carrier segment 3 abuts against fixing ring segment 1, the further seal carrier segment 3 can no longer be rotationally moved relative to first seal carrier segment 3. In this manner, circumferential retention is accomplished in the separation plane in which the end faces of the segments abut each other.

Bore 17 is provided to receive a pin for connecting two adjacent fixing ring segments 1.

Figure 5:
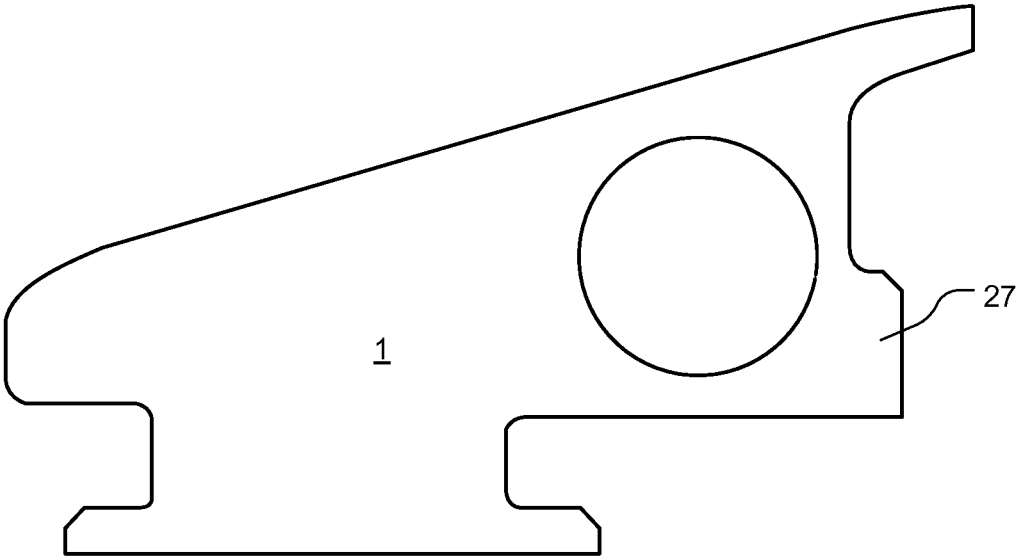
FIG. 5 is end an elevation view of a fixing ring segment of an inner ring according to the present invention having a radially inner ring segment shoulder.

FIG. 5 shows an end elevation view of a fixing ring segment of inner ring 100 according to the present invention having a radially inner segment shoulder 27.

This fixing ring segment 1 is intended to receive seal carrier segment 3, which is rotationally movable in the circumferential direction.

Figure 6:
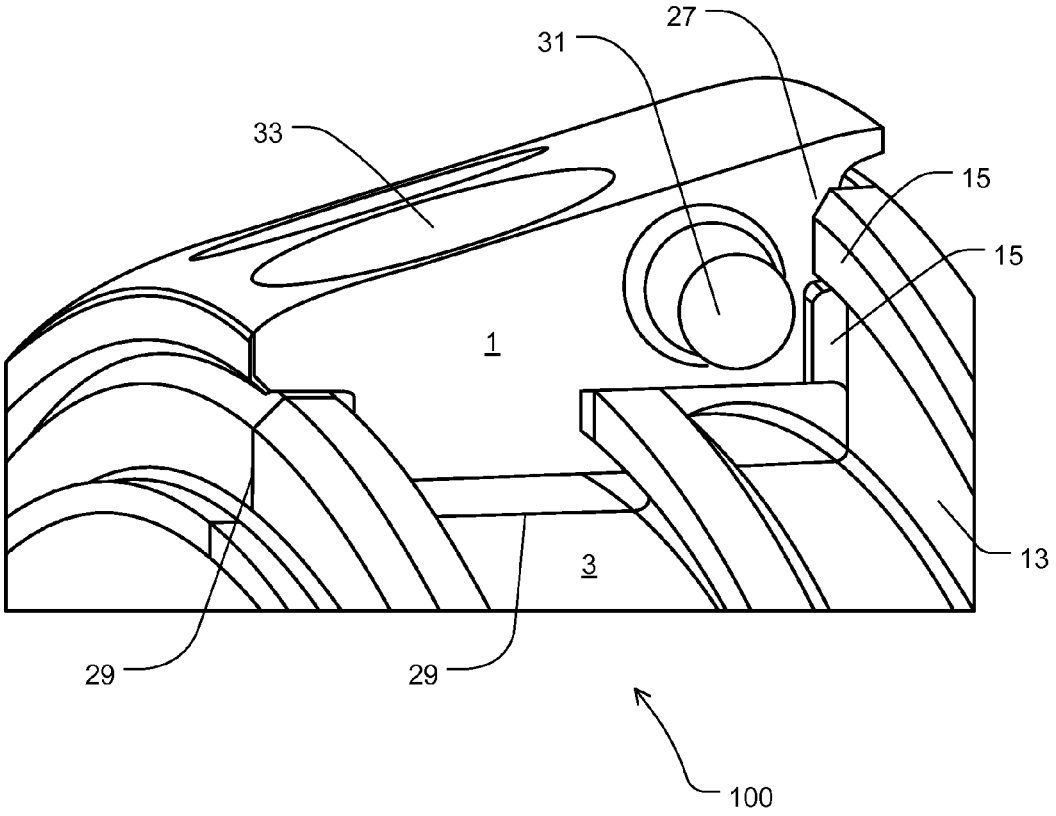
FIG. 6 is a perspective view of an inner ring according to the present invention having two seal carrier segments and one fixing ring segment.

FIG. 6 shows a perspective view of an inner ring 100 according to the present invention having two seal carrier segments 3 and one fixing ring segment 1.

Seal carrier segment 3 (the rear seal carrier segment 3 in FIG. 6) is slid onto fixing ring segment 1. At separation plane 29, seal carrier segment 3 (the front seal carrier segment 3 in FIG. 6) bears with carrier segment shoulder 15 against ring segment shoulder 27 of fixing ring segment 1. Rear and front seal carrier segments 3 differ in design due to the radially offset carrier segment shoulders 15. Radially offset carrier segment shoulders 15 and radially offset ring segment shoulders 27 (only one ring segment shoulder 27 is shown in FIG. 6) cannot move beyond separation plane 29, and thus provide retention in the circumferential direction.

A pin 31 is inserted into bore 17 (see FIGS. 1 and 4) to allow fixing ring segment 1 to be connected to a further fixing ring segment 1.

Recesses 33 are provided and configured to connect stator vane 5 to fixing ring segment 1 of inner ring 100 according to the present invention.

Figure 7:
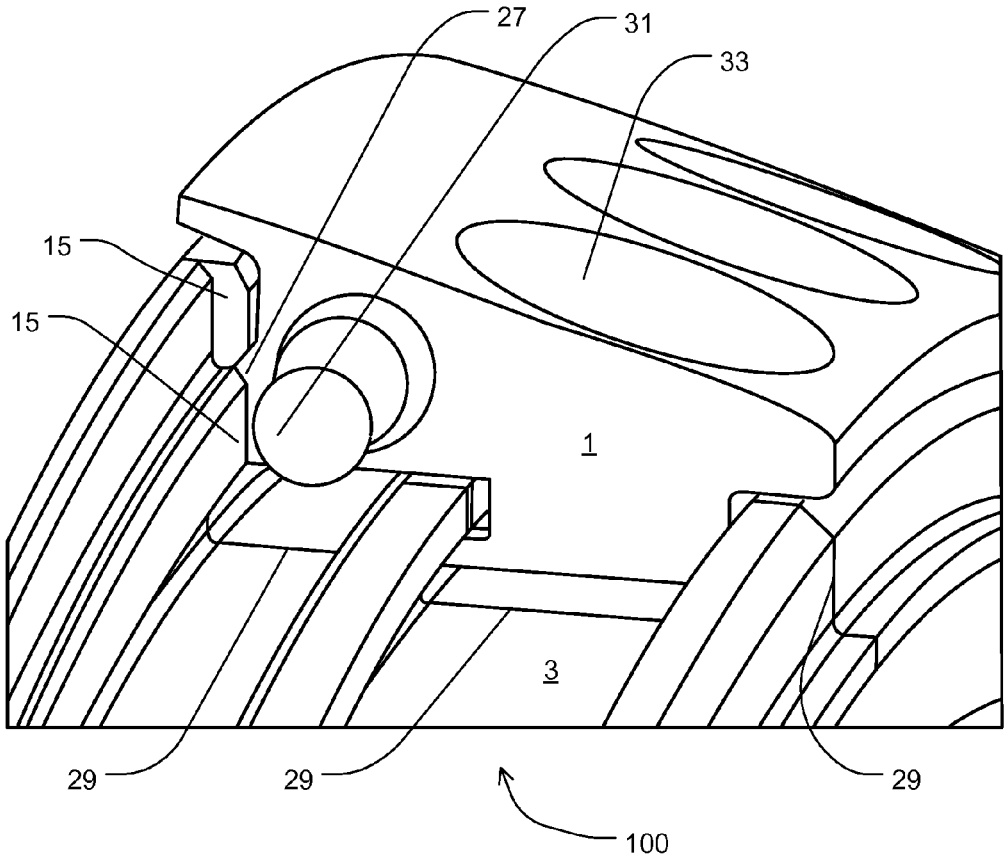
FIG. 7 is another perspective view of an inner ring according to the present invention having two seal carrier segments and one fixing ring segment.

FIG. 7 shows another perspective view of an inner ring 100 according to the present invention having two seal carrier segments 3 and one fixing ring segment 1.

Fixing ring segment 1 has a radially inner ring segment shoulder 27 (corresponding to FIG. 5). Carrier segment shoulder 15 of front seal carrier segment 3 bears against ring segment shoulder 27, preventing seal carrier segment 3 from moving beyond separation plane 29 in the circumferential direction.

LIST OF REFERENCE NUMERALS

100 inner ring
a axial; axial direction
r radial; radial direction
u circumferential direction
1 fixing ring segment
3 seal carrier segment
5 stator vane
7 seal segment; abradable seal; abradable seal coating
9 slide
11 guide
13 radial portion; bulkhead
15 carrier segment shoulder
17 bore
19 axial width of the bulkhead
21 radial extent of the bulkhead
23 axial width of the bulkhead
25 radial length or extent of the bulkhead
27 ring segment shoulder
29 separation plane
31 pin
33 recesses

What is claimed is:

1. An inner ring of a fluid flow machine for attachment to stator vanes of the fluid flow machine and for receiving seal segments, the inner ring comprising:

a fixing ring and a seal carrier, the fixing ring being split into at least a first fixing ring segment and a second ring segment and the seal carrier being split into at least a first seal carrier segment a second seal carrier segment in the circumferential direction of the fluid flow machine, and the first and second fixing ring segments and the first and second seal carrier segments being arranged in the circumferential direction with respective end faces facing each other, the first fixing ring segment having a first ring segment shoulder and the second fixing ring segment having a second ring segment shoulder offset with respect to the first ring segment shoulder;

the first seal carrier segment having a first carrier segment shoulder and the second seal carrier segment having a second carrier segment shoulder offset with respect to the first carrier segment shoulder; and in a separation plane of the inner ring, the first carrier segment shoulder at least partially abutting the second ring segment shoulder at respective end faces; and, in the separation plane, the second carrier segment shoulder at least partially abuts the first ring segment shoulder at the respective end face.

2. The inner ring as recited in claim 1 wherein the first ring segment shoulder is integrally connected to the first fixing ring segment or the second ring segment shoulder is integrally connected to the second fixing ring segment or the first carrier segment shoulder is integrally connected to the first seal carrier segment or the second carrier segment shoulder is integrally connected to the second seal carrier segment.

3. The inner ring as recited in claim 1 wherein the first and second fixing ring segments each have a circumferential angle of 180 degrees or the first and second seal carrier segments each have a circumferential angle of 180 degrees.

4. The inner ring as recited in claim 1 wherein the first carrier segment shoulder is located at the radially outer end of the first seal carrier segment or the first ring segment shoulder is located at the radially outer end of the first fixing ring segment.

5. The inner ring as recited in claim 1 wherein the first or the second carrier segment shoulder or the first or the second ring segment shoulders each extend over the entire circumferential length of the respective first or second seal carrier segment or first or second fixing ring segment.

6. The inner ring as recited in claim 1 wherein the first or the second carrier segment shoulder is disposed on an axially downstream, radially extending portion of the respective first or second seal carrier segment.

7. The inner ring as recited in claim 6 wherein the ratio of a radial extent to an axial width of the portion is at least 6:1.

8. The inner ring as recited in claim 1 wherein the first or the second fixing ring segment includes at one or both end faces at least one bore in the circumferential direction, the bore configured to receive a pin for connecting the other of the first or second fixing ring segment.

9. The inner ring as recited in claim 1 wherein the first or the second seal carrier segment has abradable seals for sealing off against a fluid medium of the axial fluid flow machine.

10. The inner ring as recited in claim 1 wherein the first and second seal carrier segments or the first and second fixing ring segment are manufactured as turned parts.

11. A stator vane array of a fluid flow machine comprising stator vanes attached to the inner ring as recited in claim 1.

12. The stator vane array as recited in claim 11 wherein the stator vane array is connectable to a casing of a compressor.

13. The stator vane array as recited in claim 11 wherein the stator vane array is connectable to a casing of an axial high-pressure compressor.

* * * * *